United States Patent [19]

Patterson

[11] 3,964,200

[45] June 22, 1976

[54] LOCKING TRIGGER GUARD

[76] Inventor: Leslie A. Patterson, 565 Sagamore Ave., Apt. 15, Portsmouth, N.H. 03801

[22] Filed: Apr. 7, 1975

[21] Appl. No.: 565,341

[52] U.S. Cl. ..... 42/70 E; 42/1 Y
[51] Int. Cl.[2] ..... F41C 17/02; F41C 27/10
[58] Field of Search ..... 42/1 Y, 70 E

[56] References Cited

UNITED STATES PATENTS

| | | | |
|---|---|---|---|
| 1,070,965 | 8/1913 | Jones | 42/70 E |
| 1,360,950 | 11/1920 | Herren | 42/70 E |
| 2,657,490 | 11/1953 | Browning | 42/1 Y |
| 2,874,503 | 2/1959 | Niesp | 42/70 E |

*Primary Examiner*—Charles T. Jordan
*Attorney, Agent, or Firm*—Edward J. Quirk

[57] ABSTRACT

A locking mechanism for a trigger-operated firearm comprises a base plate adapted to be attached to the underside of the firearm frame, and a trigger guard member which slidably engages the base plate. The trigger guard may be moved from a forward locked position, wherein the rear portion of the arcuate trigger guard abuts the trigger thereby preventing actuation of the trigger, to a rearward activated position which allows free movement of the trigger. A spring-operated latch activates the trigger guard member in either the locked or the activated position. When the trigger guard member is in the locked position, a padlock receiving orifice in the base plate is exposed; when the shackle of a padlock is extended through this orifice in the base plate, the guard member cannot be moved to the activated position.

10 Claims, 4 Drawing Figures

LOCKING TRIGGER GUARD

BACKGROUND OF THE INVENTION

The problem of gun safety has long been recognized, and many devices have been proposed to prevent a gun from accidental firing during carrying or cleaning, or from discharge by children who are unaware of the dangers inherent in firearms. For example, Lentz, U.S. Pat. No. 3,368,297 discloses a curved rod type device having one end adapted to fit in the gun barrel, and the other end locked to the trigger guard with a padlock. Womble, U.S. Pat. No. 3,031,787, describes a rigid sheath which fits over a trigger guard of the firearm, enclosing the trigger and preventing accidental discharge. Both these devices are somewhat cumbersome add-ons, which must be carried separately when the gun is in use, and which may be lost. Other similar add-on devices are described in Small U.S. Pat. No. 3,711,979, and Charters U.S. Pat. No. 2,505,227.

Many other built-in safety devices are also known. For example, Niesp, U.S. Pat. No. 2,874,503 discloses a slidable locking bar having a forward magnetized end which engages the rear of the trigger. The bar extends through the rear of the trigger guard, and is released automatically by the hand of the firer when he grips the gun. Meunier, U.S. Pat. No. 3,195,259, describes a pivoted trigger guard for a dual trigger pistol wherein motion of one of the two triggers is blocked at all times when the guard is in position. Application of this principle is limited to dual trigger guns, and no provision is made in Meunier for a trigger guard when the forward trigger is to be used. Stephan, U.S. Pat. No. 920,682, provides a biased, pivoted locking arm which extends through the trigger guard to engage the trigger ends.

Fraser, U.S. Pat. No. 2,525,886, discloses firearms having a movable trigger guard which shields the trigger when in the inoperable position. However, the mechanism is somewhat cumbersome and can be accidentally tripped. In addition, the gun has no trigger guard when the guard is moved to the operable position, and the guard cannot be permanently locked in the inoperable position.

These mechanisms are generally somewhat unsightly and do not provide the ability to permanently lock the trigger, i.e., with a padlock, to prevent usage by unauthorized users or children.

The present invention provides a simple and relatively inexpensive, yet entirely effective mechanism for locking trigger type guns. A trigger guard member slides between a forward locked position and a rearward activated position. A biased pushbutton releases a latch which holds the guard in either of the two aforementioned positions; accordingly, both an upward pressing motion on the pushbutton and a rearward sliding motion are required to move the guard to the activated position, thus minimizing the possibility of accidental discharge. When in the forward position, the trigger guard abuts the rear of the trigger, preventing its movement; in this position, an orifice adapted to receive the shackle of a padlock is also exposed. When the padlock is in position, the guard cannot be returned to the activated position. The guard mechanism of the invention may easily be added to existing firearms, or may be included in the initial contruction of the firearm. The guard can be unlocked by pressing the latch button and sliding the guard backward; it can be locked simply by sliding the guard forward. No unsightly, cumbersome, or removable devices are necessary.

SUMMARY OF THE INVENTION

A locking mechanism for a trigger-operated firearm comprises a base plate attachable to the underside of the firearm frame, a locking member received by the base plate and in sliding engagement therewith, a lower trigger guard portion of the locking member enclosing the trigger, said locking member being selectively positioned between a first locked position wherein the trigger guard abuts the trigger, preventing its movement, and a second position allowing movement of the trigger unrestricted by the trigger guard, and a latch for releasably holding the sliding locking member in the first or second position.

DETAILED DESCRIPTION OF THE INVENTION

Figure 1:
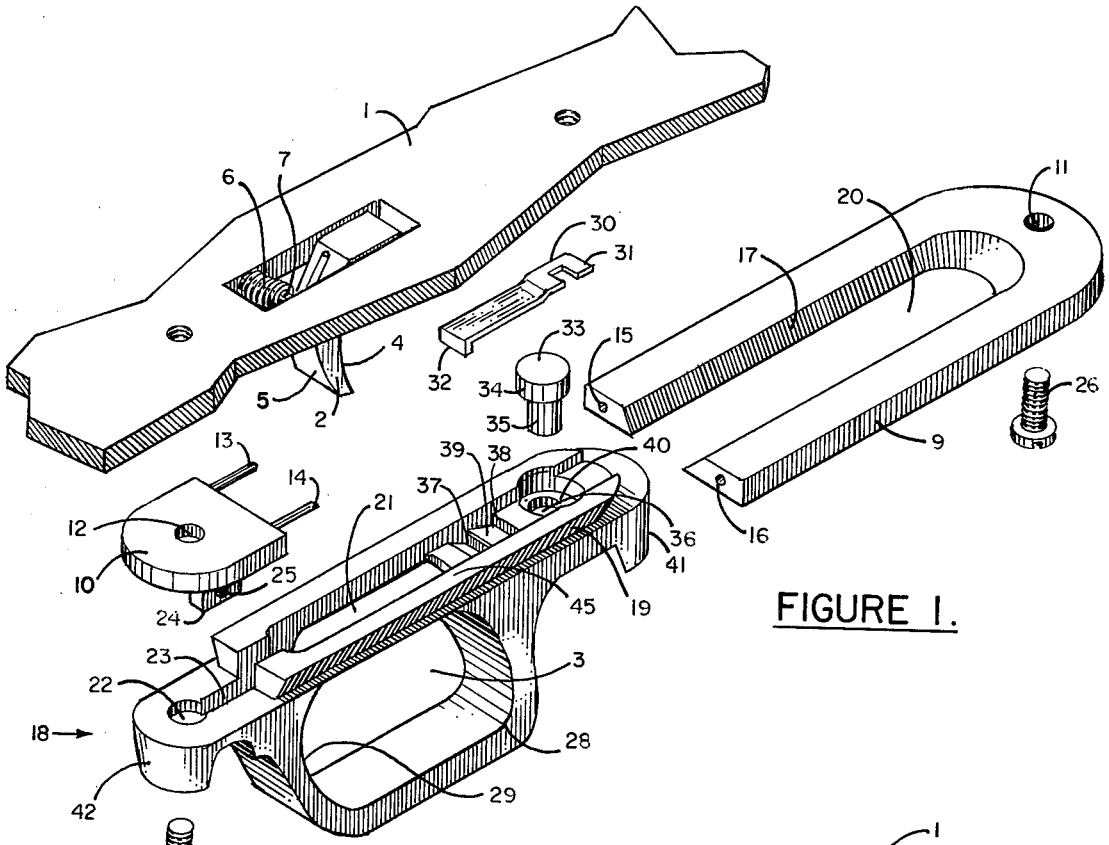
FIG. 1 is an exploded perspective view of the locking mechanism of the invention.

Referring to the drawings, item 1 is a section of a firearm frame which carries trigger 2. The trigger is shown suspended in the frame by a dowel pin engaging holes in the side of the frame (not shown). The trigger extends downwardly through orifice 3 in the frame. The trigger has a rear surface 5, and a front surface 4 which is contacted by the firer's index finger and pulled rearwardly for firing. The trigger is urged to its forward, or "ready" position by spring 6 mounted on dowel bar 7. The trigger may be mounted in any way, and the mounting forms no part of the invention. The trigger actuates the firing pin (not shown) of the firearm in any conventional way; this mechanism is not critical and is not shown.

The locking device of the invention consists of two basic components: a base plate for fixing the device to the rifle, and a locking mechanism, including a trigger guard, which is carried in sliding engagement with the base plate. Base plate 8 is shown in two sections, consisting of forward section 9 and rear section 10, for ease of mounting. The two sections are assembled by guiding dowel pins 13 and 14 on the rear section into their respective channels 15 and 16 in forward section 9.

Locking member 18 comprises an upper portion 45 having an outwardly bevelled longitudinal surface 19 on either side of the locking member. Locking member 18 is carried by base plate 8, with outwardly bevelled surface 19 slidably supported on inwardly bevelled shelf 17 of the base plate. Member 18 slides longitudinally in base plate 8 between a forward position, best shown in FIGS. 2 and, in phantom, in FIG. 4, and a rearward position shown in FIGS. 3 and 4. When the locking member is in the forward position, the rear inner surface 29 of the trigger guard abuts the rear surface 5 of trigger 2, preventing rearward motion of the trigger and thereby locking the trigger. Although desirable, it is not necessary that the trigger be in direct abutment with the trigger guard, however, it is essential that the rear inner surface of the trigger guard block the rearward motion of the trigger such that the trigger cannot be pulled back sufficiently far to actuate the firing mechanism. By comparison of the locked and unlocked side views of the locking device in FIGS. 2 and 3, it is clear that one can easily see from a distance whether or not the gun is in the locked position. If the trigger is unlocked, the space between the trigger and the rear face of the trigger guard can be seen at a glance.

Figure 2:
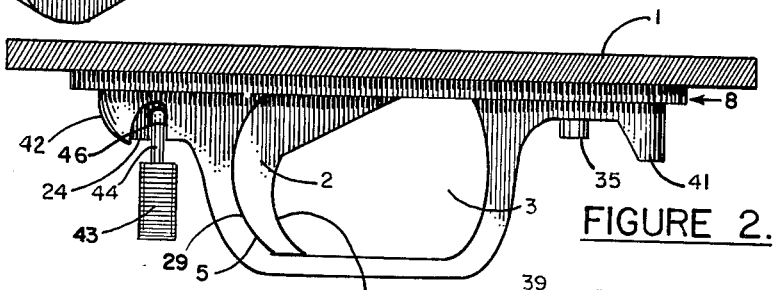
FIG. 2 is a side view of the locking mechanism in locked position and with the padlock in place.
Figure 3:
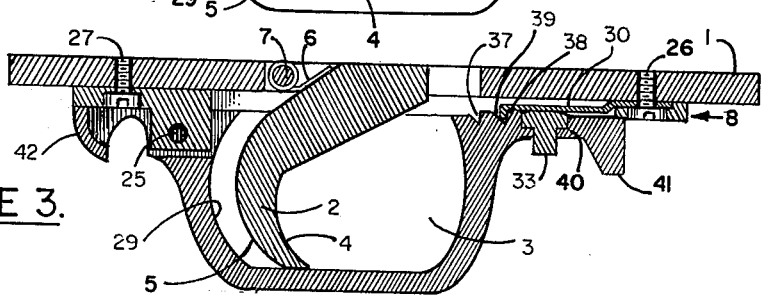
FIG. 3 is a longitudinal section of a side view of the locking mechanism in operative position.

The locking member is maintained in the locked or unlocked position by a latch arrangement consisting of leaf spring 30 having a single downwardly projecting catch 32 which coacts with notches 37 and 38 in the upper surface of the locking member. When in place, leaf spring 30 rests on the upper surface of the locking member and is secured by engagement of the hook-like forward end 31 with mounting screw 26 (best seen in FIG. 3.) The leaf spring resiliently biases the catch toward the locking member so that the catch will automatically interlock with one of the notches 37 or 38. Pushbutton 33, for manipulating the leaf spring, consists of two concentric dowel sections, the upper section 34 having a large diameter, and normally rests in orifice 36 near the front of the locking member. Seat 40 in the orifice supports the pushbutton by engaging the lower surface of the upper dowel member; the lower dowel member 35 extends completely through the orifice 36 and is accessible to be pressed upwardly as shown in FIGS. 2 and 3. The upper surface of dowel member 34 abuts the underside of spring 30, which biases the pushbutton to its normal position shown in FIG. 3. When the pushbutton is depressed upwardly, the leaf spring lifts from the surface of the locking member, disengaging catch 32 from notch 37 and allowing the locking member to slide to the rearward (unlocked) position. The pushbutton must be depressed to move the locking member to the unlocked position; however, the locking member may be moved from the unlocked to the locked position simply by urging the locking member forward. Referring to FIG. 3, when the locking member is pushed forward, catch 32 rides up the rearwardly inclined surface 39 between notches 38 and 37, and will proceed in this direction until the catch is urged into notch 37 by leaf spring 30. Because of the abutment of the catch with the front vertical surface of notch 38, the locking member cannot be returned to the unlocked position until pushbutton 33 is depressed, releasing the catch from notch 37. The dual motion required to move the lock to the activated position is an additional safety feature of the device of the invention. To activate the trigger, the firer must first push the release button upwardly, and then slide the locking member backward. This can be effected intentionally in one very rapid, short motion, however, it is highly unlikely that both motions could occur simultaneously by accident, such as when the gun is being carried.

The locking mechanism is assembled by sliding the two base plate members over the two ends of the upper portion of the locking member such that bevelled surface 17 and 19 of the base plate and locking member, respectively, are in sliding contact. Base plate members 9 and 10 are urged together until the dowel pins 13 and 14 mate with channels 15 and 16 and the two pieces fit flush. Once installed, if desired the two base plate members may be permanently welded together. Pushbutton 33 is dropped in place in orifice 40, and leaf spring 30 is laid thereover with the opening in the hook end 31 fitting directly over mounting hole 11 in the baseplate with the catch 32 engaging notch 38 in the unlocked position. Mounting screw 26 is then placed through countersunk mounting hole 11 in the base plate and through the opening in hook 31, and mounting screw 27 inserts through holes 22 in the locking member and 12 is the base plate. Both screws are then fixed into the firearm frame.

Figure 4:
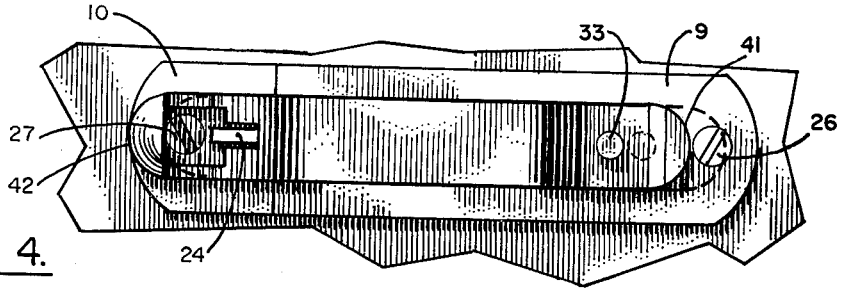
FIG. 4 is a bottom view of the locking mechanism in locked position, with the unlocked position shown in phantom.

Once installed, the mounting screws cannot be removed unless the locking member is in the unlocked position. FIG. 4 is a bottom view of the locking mechanism showing the locking member in unlocked position, with the mounting screws accessible for removal. The locked position is shown in phantom in FIG. 4, with the rear shield portion 42 of the locking member covering mounting screw 27 and pushbutton shield 41 covering forward mounting screw 26. The inability to remove the locking mechanism when it is in the locked position adds another degree of safety to the device of the invention. Pushbutton shield 41 is simply a downwardly extending abutment to prevent accidental actuation of the pushbutton, e.g., when the firearm is carried over an arm or shoulder.

The locking mechanism of the invention may be fastened permanently in the locked position with a padlock. Lock receiving tooth 24 attached to the bottom of base plate section 10 extends downwardly through slot 23 in locking member 18, and is exposed in the curved cutaway formed by the upper rear portion of the trigger guard 28 and the forward portion of locking tooth shield 42. FIG. 2 illustrates the locking mechanism in the locked position with a padlock 43 in place. Padlock shackle 44 extends through orifice 25 in tooth 24, preventing any substantial rearward movement of the locking member 18. Even if the pushbutton were actuated in this case, the padlock shackle would contact the vertical rear portion 46 of the trigger guard should an effort be made to slide the locking member to the unlocked position.

The locking mechanism of the invention can be added as a permanent add-on feature to most present firearms by removing the existing trigger guard, drilling and tapping two holes in the gun frame to receive the mounting screws, and assembling and mounting the mechanism as described above. The locking mechanism can be installed during the manufacture of a new gun by incorporating the base plate design into the gun frame.

While a specific preferred embodiment of the invention has been described herein, many variations will be readily apparent to those skilled in the art within the spirit of the invention, the concept of which is a slidable trigger guard which in the locked position blocks the firing motion of the trigger and thereby prevents the gun from being fired. These variations are consistent with the scope of the invention and are intended to be included in the scope of the following claims.

I claim:

1. A locking mechanism for a firearm having a frame and having a movable trigger depending from the firearm frame, said mechanism comprising:

an elongated base plate attachable to the firearm frame;

a locking member carried by said base plate having an upper portion being in longitudinal sliding engagement with said base plate, and a lower portion comprising a trigger guard enclosing the trigger in the plane of motion of the trigger, said locking member being movable between a forward locked position wherein the trigger guard blocks the rearward motion of the trigger, and a rearward unlocked position allowing full motion of the trigger; and latch means cooperating with the locking member to releasably engage the locking member in the locked and unlocked positions.

2. The locking mechanism of claim 1 also comprising padlock receiving means carried by the base plate for securing the locking member in the locked position.

3. The locking mechanism of claim 2 wherein the locking member has an edge thereof located adjacent the padlock receiving means when the locking mechanism is in the locked position, such that when a padlock is engaged in the padlock receiving means, said padlock blocks any motion of the locking member in the direction of the unlocked position.

4. The locking mechanism of claim 1 also comprising fastening means for attaching the base plate to the firearm frame, said fastening means being located in the base plate such that the locking member prevents access to the fastening means when the locking member is in the locked position, and allows access to the fastening means when the locking member is in the unlocked position.

5. The locking mechanism of claim 1 wherein the latch means comprises a plurality of notches in said locking member, a leaf spring carried by the base plate having a tooth thereon adapted to engage said notches and resiliently biased toward said notches, and a manually operated release button for disengaging the tooth from the notches.

6. In a safety mechanism for a firearm, a firearm frame, a movable trigger, a base plate mounted in the underside of said frame, a trigger guard member received by said base plate in longitudinal sliding engagement therewith, said trigger guard member being movable between a forward locked position wherein the trigger guard abuts the trigger, thereby preventing substantial rearward motion thereof, and a rearward unlocked position allowing full motion of the trigger, and latch means cooperating with the trigger guard member to releasably engage the trigger guard member in the locked and unlocked positions.

7. The locking mechanism of claim 6 also comprising padlock receiving means carried by the base plate for securing the locking member in the locked position.

8. The locking mechanism of claim 7 wherein the locking member has an edge thereof located adjacent the padlock receiving means when the locking mechanism is in the locked position, such that when a padlock is engaged in the padlock receiving means, said padlock blocks any motion of the locking member in the direction of the unlocked position.

9. The locking mechanism of claim 6 also comprising fastening means for attaching the base plate to the firearm frame, said fastening means being located in the base plate such that the locking member prevents access to the fastening means when the locking member is in the locked position, and allows access to the fastening means when the locking member is in the unlocked position.

10. The locking mechanism of claim 6 wherein the latch means comprises a plurality of notches in said locking member, a leaf spring carried by the base plate having a tooth thereon adapted to engage said notches and resiliently biased toward said notches, and a manually operated release button for disengaging the tooth from the notches.

* * * * *